United States Patent [19]

Williams

[11] 4,036,142

[45] July 19, 1977

[54] OBSCURATION FUZE AND SENSOR

[75] Inventor: David Williams, Bethesda, Md.

[73] Assignee: The United States of America as represented by the Secretary of the Army, Washington, D.C.

[21] Appl. No.: 610,204

[22] Filed: Jan. 18, 1967

[51] Int. Cl.[2] ..... F42C 13/02; F42C 19/12; F42C 11/00

[52] U.S. Cl. ..... 102/70.2 R

[58] Field of Search ..... 102/70.2

[56] References Cited

U.S. PATENT DOCUMENTS

| | | | |
|---|---|---|---|
| 2,882,822 | 4/1959 | Crane | 102/70 |
| 2,927,213 | 3/1960 | Marion et al. | 102/70.2 X |
| 3,228,337 | 1/1966 | Grantham et al. | 102/70.2 |

*Primary Examiner*—Verlin R. Pendegrass
*Assistant Examiner*—Thomas H. Webb
*Attorney, Agent, or Firm*—Nathan Edelberg; Robert P. Gibson; Saul Elbaum

[57] ABSTRACT

A nose mounted obscuration fuze adapted to produce a near surface burst when the fuze approaches or starts to penetrate a target. The nose of the fuze is provided with a pair of relatively broad surfaces, one of which transmits light from a light source across an air gap forming a sensing area to a light detector in the other broad face of the sensor. The light transmission is measured between the two faces, and any significant change in light transmission through the air gap, such as when the fuze penetrates snow, activates the fuze.

10 Claims, 3 Drawing Figures

INVENTOR
DAVID WILLIAMS

BY Harry M. Saragovitz, Edward J. Kelly, Herbert Berl & J. D. Edgerton
ATTORNEYS

OBSCURATION FUZE AND SENSOR

This invention may be manufactured by or for the Government of the United States for Governmental purposes without the payment to me of any royalties thereon.

This invention relates to a proximity fuze and more particularly, to an obscuration fuze adapted to produce a near surface burst when the nose mounted fuze approaches starts to penetrate a target.

As is well known, certain explosive effects are inhanced by exploding a projectile as it approaches a target rather than exploding it on impact. For this purpose, a wide variety of proximity fuzes have been developed. Perhaps the best known is the radio proximity fuze developed during World War II. Other types of proximity fuzes include capacitive fuzes, sound proximity devices, and those relying upon optical transmissions both in the invisible and visible frequency spectrums. A proximity fuze relying upon light reflected from a target at a predetermined angle to detonate the fuze is disclosed in U.S. Pat. No. 2,255,245.

However, certain types of terrain are very difficult to sense with any of the known fuze systems and one of these is terrain that is covered by a very light dry snow. A radio or capacity fuze has difficulty sensing such terrain because the electrical characteristics of dry, powdery snow are not much different from those of the atmosphere above the snow. That is to say, the discontinuity at the air-snow interface is small when measured in terms of electrical characteristics such as dielectric constant, loss tangent and the like. Light transmission devices are of course, subject to variations in atmospheric conditions and likewise are not completely satisfactory for sensing ground terrain covered with snow under adverse weather conditions. The air-snow discontinuity is, however, appreciable, if measured in terms of light transmission through the medium and it is this appreciable discontinuity that forms the basis for the obstruction fuze of the present invention.

According to the present invention, the nose of the fuze is provided with a pair of relatively broad surfaces, one of which transmits light from a light source across an air gap forming a sensing area to a light detector in the other broad face of the sensor. The light transmission of the medium is then measured between the two faces, and any significant change in light transmission through this detection area or air gap, such as when the fuze penetrates the snow, activates the fuze. The height of the light source may be small but the width perpendicular to the fuze axis should be great enough so that a rain drop falling through the measuring gap only cuts the light transmission by a fraction, for example 25%. In this way, the fuze is usable even under adverse weather conditions to initiate detonation of a projectile charge as the fuze approaches the ground, that is as the fuze starts to penetrate a layer of snow over the ground.

It is therefore one object of the present invention to provide a new and improved fuze sensor for initiating a near surface burst.

Another object of the present invention is to provide a novel obscuration fuze sensor and system which is operated by substantial changes in the light transmitting properties of the medium surrounding the fuze.

Another object of the present invention is to provide a fuze and fuze sensor activated by changes in the direct transmission of light from one portion of the sensor to another.

Another object of the present invention is to provide a fuze suitable for use in exploding a charge near terrain covered by a very light, dry snow. In the present invention, a light source transmits light from one broad surface of the sensor to another and variations in the transmission of the light resulting from changes in the medium surrounding the sensor operate a suitable electronic switching circuit to actuate the fuze.

These and further objects and advantages of the invention will be more apparent upon reference to the following specification, claims an appended drawings wherein:

Figure 1:
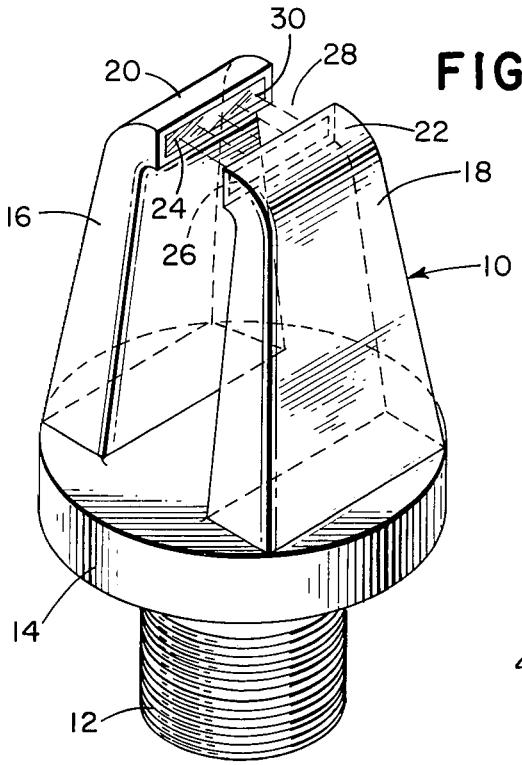
FIG. 1 is an isometric view with portions illustrated in phantom and showing one form of fuze sensor constructed in accordance with the present invention.

Referring now to the drawings, the fuze sensor generally indicated at 10 in FIG. 1, comprises a threaded stem 12 adapted to be threaded into the nose of the fuze in a conventional manner which stem supports a circular base 14. Projecting forwardly of the base 14 are a pair of hollow arms 16 and 18 having turned-over ends forming flanges 20 and 22. The flanges 20 and 22 terminate in the broad surfaces 24 and 26 which are adjacent to but slightly spaced from each other, to define an air gap or sensing area 28 across which an elongated narrow band of light is transmitted as indicated by the parallel light rays in FIG. 1. Arm 16 contains a light source which passes light outwardly through a suitable aperture or light transmitting window of appropriate material indicated at 30. The light is transmitted through the space 28 between faces 24 and 26 and passes into arm 18 through a similar aperture or window to a light detector contained in arm 18.

The light transmission of the medium surrounding the sensor is measured in the area 28 between the terminating faces of the flanges on arms 16 and 18. While any suitable configuration may be utilized, the faces (and corresponding windows or apertures) 24 and 26 are preferably rectangular and of equal size. The height of the area parallel to the fuze axis from which the light emanates from arm 16 may be small but the width (perpendicular to the fuze axis) should be long enough so that a rain drop falling through the measuring gap only cuts the light transmission by a fraction, for example, not over 25% A length of one inch has been found completely adequate. The receiver window has a similar configuration so that the fuze is able to intercept raindrops without producing a signal that is as large as the signal generated when light snow is placed between the measuring faces 24 and 26.

Figure 2:
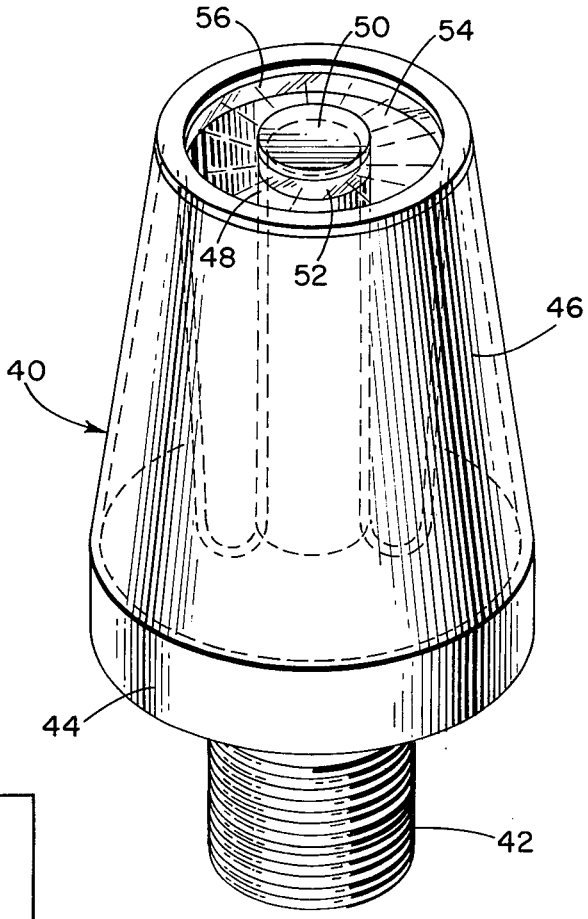
FIG. 2 shows a modified obscuration fuze sensor in accordance with the present invention incorporating radial type light transmission.

FIG. 2 shows a modified fuze sensor generally indicated at 40 again comprising a threaded stem 42 adapted to be received in a conventional manner in the nose of a projectile fuze and connected to a circular or a disc-shaped base 44. Mounted on the base 44, are a pair of hollow concentric rings including an outer ring 46 and an inner ring 48, the latter preferably closed off at its upper end by a light opaque cap 50. As illustrated, outer ring 46 preferably tapers toward the front of the sensor and is preferably of truncated conical shape whereas inner ring 48 may be formed as a right circular cylinder. Cap 50 is joined to the remainder of hollow inner ring 48 by a suitable light transmitting material such as plastic or the like forming an annular window 52 which radiates light radially toward outer ring 46 as indicated by the light rays in FIG. 2 in the sensing area 54. Positioned within inner ring 48 is a light source for directing light outwardly through window 52 to outer ring 46.

Outer ring 46 is preferably formed by spaced inner and outer walls and contains an annular ring of suitable light transmitting plastic forming a receiving window 56 for the light rays transmitted to it from transmitting window 52. Light received through the window 56 impinges upon a light detector in the outer ring such that any substantial reduction in the transmission of light to window 56 actuates the device.

Figure 3:
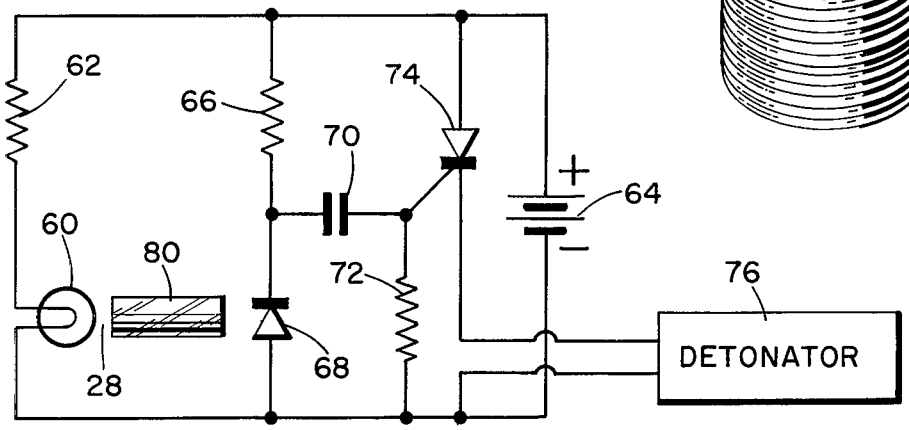
FIG. 3 is a simplified circuit diagram for the fuze system of the present invention.

FIG. 3 shows a simplified circuit diagram for the sensor and fuze system of the present invention. In FIG. 3, a light source 60 such as an incandescent light is coupled through a current limiting resistor 62 to the opposite sides of a suitable power supply as indicated by the fuze batter 64. Also coupled to the fuze batter through dropping resistor 66, is a light detector in the form of a photo-diode 68. A signal from the photo-diode passes through an RC circuit comprising capacitor 70 and resistor 72 to the control element of a silicon controlled rectifier 74 which when switched on, passes current from the power supply 64 to a detonator circuit or squib 76.

While not necessary, it is preferable to have the light from source 60 passing through sensing area 28 in FIG. 3, led to the photo-diode 68 through a light tube 80 such as a lucite light pipe or a fiber optic bundle. While the light source in arm 16 of FIG. 1 may be placed near face 24, the light detector 68 should preferably be placed near the base of the fuze and the fiber optics or lucite pipe used to carry the light to the detector. The reason for this is that if the round impacts on a hard terrain, the light detector should see a reduction in light to detonate the projectile before the detector breaks up. If desired, a lens system may be employed in arm 16 to produce the sheet shaped beam of light across the measuring volume of area 28.

The light source may be an incandescent bulb, a semiconductor light source, a pyro-technique light source, or other similar device. The light detector is preferably a silicon photo-diode with a response time on the order of a micro-second. The battery 64 provides power for the light source (when required) and for the firing circuit. Operation is preferably in the visible spectrum but infrared or other invisible light sources and detectors may be utilized.

It is of course, apparent that greater sensitivity can be obtained by placing amplifiers between the detector and the silicon controlled rectifier switch.

As is apparent from above, the present invention provides a novel obscuration type fuze for producing near surface bursts over terrain covered by snow. It is particularly adapted for use when ground is covered by a very light, dry snow which is not readily suited to other types of fuzes such as the radio or capacitive fuzes due to the lack of a sufficiently detectable discontinuity at the air-snow interface.

The invention may be embodied in other specific forms without departing from the spirit or essential characteristics thereof. The present embodiment are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

I claim:

1. An obscuration fuze comprising means defining a sensing gap, a light source coupled to said means for directing light across said gap, a detector coupled to said means for sensing changes in the light conductivity of the medium within said gap, and firing means coupled to said detector for exploding a charge in response to changes in the light conductivity of said medium.

2. A fuze according to claim 1 wherein said source produces light in the visible spectrum.

3. A fuze according to claim 1 wherein said source produces light in the invisible spectrum.

4. A fuze according to claim 1 wherein said light source is shaped so as to transmit across said gap a sheet shaped beam of light transverse to the longitudinal axis of said fuze.

5. A fuze according to claim 4 wherein said beam of light is rectangular.

6. A fuze according to claim 4 wherein said beam of light is annular with the light directed radially of said axis.

7. A fuze according to claim 1 wherein said light source is an incandescent bulb and said detector is a silicon photodiode.

8. A fuze according to claim 1 including a light pipe for passing light from said gap to said detector.

9. A fuze according to claim 1 wherein said gap is formed by a pair of adjacent broad surfaces having their smallest dimension parallel to the longitudinal axis of said fuze.

10. A fuze according to claim 1 wherein said detector is coupled to said firing means through a silicon controlled rectifier.

* * * * *